US007495650B2

(12) United States Patent
Murade

(10) Patent No.: US 7,495,650 B2
(45) **Date of Patent: *Feb. 24, 2009**

(54) ELECTRO-OPTICAL DEVICE AND ELECTRONIC APPARATUS

(75) Inventor: Masao Murade, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 582 days.

This patent is subject to a terminal disclaimer.

(21) Appl. No.: 11/064,025

(22) Filed: Feb. 23, 2005

(65) Prior Publication Data

US 2005/0206608 A1 Sep. 22, 2005

(30) Foreign Application Priority Data

Mar. 19, 2004 (JP) ..... 2004-081519

(51) Int. Cl.
*G09G 3/36* (2006.01)

(52) U.S. Cl. ..... 345/103; 345/99

(58) Field of Classification Search ..... 345/87, 345/103, 94, 99; 358/474; 324/767
See application file for complete search history.

(56) References Cited

U.S. PATENT DOCUMENTS 6,980,189 B2 * 12/2005 Maruoka et al. ..... 345/94
7,053,649 B1 * 5/2006 Osada ..... 324/767
7,193,593 B2 * 3/2007 Koyama et al. ..... 345/87
2002/0030653 A1 * 3/2002 Cairns et al. ..... 345/87
2004/0004595 A1 1/2004 Isami et al.
2004/0041765 A1 * 3/2004 Koyama et al. ..... 345/87
2005/0200591 A1 * 9/2005 Satoh et al. ..... 345/103
2005/0206969 A1 * 9/2005 Murade ..... 358/474

FOREIGN PATENT DOCUMENTS

EP 0 483 972 A2 5/1992
EP 1 191 513 A2 3/2002
JP A-10-149139 6/1998
JP A-2000-112437 4/2000
JP 2000171774 A * 6/2000
JP A 2000-171774 6/2000
JP A 2003-337574 11/2003

* cited by examiner

*Primary Examiner*—Amare Mengistu
*Assistant Examiner*—Yuk Chow
(74) *Attorney, Agent, or Firm*—Oliff & Berridge, PLC

(57) ABSTRACT

Output signals of a shift register in which latch circuits are connected in a plurality of stages are branched into two paths, NAND circuits are provided at the respective branched paths, and a sampling switch is turned on based on the output signals to sample an image signal into a data line. However, in response to the NAND circuit arranged at the left-branched path of the two path of a signal output by the first stage and the NAND circuit arranged at the right-branched path of the two path of a signal output by the last stage, neither the sampling switches nor the data lines are provided. With this, degradation of display quality is suppressed.

7 Claims, 11 Drawing Sheets

ELECTRO-OPTICAL DEVICE AND ELECTRONIC APPARATUS

BACKGROUND

The present invention relates to a technology for suppressing degradation of image quality in the case where data lines are driven in a block for a plurality lines.

In recent years, projectors using electro-optical panels, such as liquid crystal panels, to form small images and for amplifying and projecting the small images on a screen or a wall with an optical system have been widely used. These projectors do not have a function to form images on their own, but receive image data (or image signals) from some higher-level devices, such as PCs or television tuners. The image data designates a gray-scale level (brightness) of a pixel, and is supplied in a vertical-scanning-type manner or a horizontal-scanning-type method to pixels arranged in a matrix, so that it is desirable even for an electro-optical panel for use in a projector to be driven in these ways. Therefore, an electro-optical panel for use in a projector selects scanning lines one after another, and sequentially selects data lines one-by-one for a period where one scanning line is selected (one horizontal scanning period), and the image data is generally driven using a point sequential method, such that the image data, transformed to be suitable for driving the liquid crystal, is supplied to the selected data line.

However, recently, there has been a strong demand for high precision in response to developments in high-definition technology. High definition can be achieved by increasing the number of scanning lines and the number of data lines, and one horizontal scanning period becomes reduced due to the increase in the number of scanning lines. Furthermore, with the point sequential method, the period for selecting data lines is also reduced due to the increase in the number of data lines. For this reason, with the point sequential method, an insufficient time can be obtained to supply image signals to the data lines, as high-definition technology progresses, causing the pixels to be insufficiently written.

With the aim of overcoming the insufficient writing described above, phase expansion driving has been proposed. The phase expansion method refers to a method in which a predetermined number of the data lines (e.g., 6 data lines) are selected for every one horizontal scanning period, and image signals of the pixels corresponding to intersections of the selected scanning lines and the selected data lines are selected and extended by 6 times along the time axis to supply them to each of the 6 data lines. It has been understood that phase expansion driving is suitable for high definition since the time for supplying image signals to the data lines can be extended 6 times longer than that for the point sequential method.

However, in the phase expansion drive, a plurality of data lines are selected at the same time, resulting in degradation of image quality.

SUMMARY

The present invention has been conceived to solve these problems, and an object of the present invention is to provide an electro-optical device and an electronic apparatus capable of suppressing degradation of image quality and displaying high image quality.

As a premise of the present invention, among a shift register connected to a plurality of stages, a pulse signal output from the first stage may be different in terms of a condition and waveform compared to that of pulse signals output from other stages. However, when the region to which the pulse signal is output is referred to as a dummy pixel, a region formed by a peripheral circuit such as registers is accordingly reduced. Here, an aspect of the present invention is to provide an electro-optical device having a plurality of pixels arranged correspondingly to intersections of a plurality of scanning lines and a plurality of data lines, for producing gray-scale levels in response to given image signals when image signals are sampled on the plurality of data lines for a period where the plurality of scanning lines are selected, the plurality of data lines being formed in blocks composed of a plurality of lines, the electro-optical device comprising: a scanning line driving circuit for selecting the plurality of scanning lines for the respective horizontal scanning periods one after another; a shift register connected to a plurality of stages for transmitting a plurality of transmission start pulse signals initially supplied for the respective horizontal scanning periods one after another according to a predetermined clock signal; a path for branching the plurality of pulse signals transmitted to the respective stages into a plurality of groups; an operation circuit for requesting a plurality of signals logically operated with the branched pulse signals and predetermined enable signals such that pulse widths do not overlap with each other; and a plurality of sampling switches, each electrically interposed between each data line and any of image signal lines that supply image signals, for turning on and sampling the image signals supplied to the image signal lines into the data lines, wherein the signals are turned on and off substantially at the same time based on the same logic signals corresponding to the same block of data lines, wherein, among logical operation signals output by the operation circuit, sampling switches to be turned on and off by start and end signals of the horizontal scanning period and data lines corresponding to the sampling switches are omitted. According to the electro-optical device of the present invention, using the logic operation signal output at the beginning of the horizontal scanning period, a sampling switch to be turned on and off and a data line corresponding to the sampling switch are omitted, and accordingly, a region where a peripheral circuit such as the shift register is arranged can be obtained.

However, when the sampling switch to be turned on and off by the logic operation signal output at the beginning of the horizontal scanning period and the data line corresponding to the sampling switch are omitted, a central position of the display is obviated from the central position of an entire pixel region. Thus, according to the present invention, among the logic operation signals output from the operation circuit, the sampling switch to be turned on and off by the logic operation signal output at the end of the horizontal scanning period and the data line corresponding to the sampling switch may preferably be also omitted.

Moreover, with the arrangement described above, among the logical operation signals output by the operation circuit, pixels corresponding to the data lines near the omitted data line may not be displayed as dummy pixel regions, for a block to which the second output signal in the horizontal scanning period is supplied. This is because, among pixel regions corresponding to the second stage, regions adjacent to the pixel regions corresponding to the first stage are easily affected (due to a capacitive coupling, etc.) due to the pixel regions corresponding to the given first stage. In addition, for the electro-optical device according to the present invention, various aspects of causing pixels to be non-display ones as dummy pixel regions can be provided, such as an aspect of causing the given pixels to be predetermined color (e.g., black and white colors) irrespective of display contents, an aspect of blocking the give pixels with a light blocking layer, and an aspect of partially or fully forming the pixel circuits.

In these arrangements, left to right inverted image may be formed, so that the dummy pixel regions may preferably be symmetrically arranged with respect to a center of an effective pixel region for performing display. In addition, in case that the image regions corresponding to the first and last stages are dummy pixel regions, and that dummy pixel regions are symmetrically arranged with respect to a center of an effective pixel region, the number of the data lines of the effective pixel region may preferably be a multiple of the number of the sampling switches turned on and off by the same logical operation signal.

In the electro-optical device according to the present invention, among the operation circuits, it may preferably be a NOT circuit for outputting a negative signal of the pulse signal transmitted by the first stage of the shift register and not inputting the enable signal which outputs the logical operation signal at the beginning of the horizontal scanning period. With this arrangement, the given operation circuit is simplified to be the NOT circuit, and accordingly, a region in which the peripheral circuit such as the shift register is arranged can be secured.

In addition, in this arrangement, among the operation circuit, it may be a NOT circuit for outputting a negative signal of the pulse signal transmitted by the last stage of the shift register and not inputting the enable signal which outputs the logical operation signal at the end of the horizontal scanning period.

Moreover, the operation circuit may further comprise a NAND circuit for calculating a negative AND on the enable signal and the pulse signals transmitted by a corresponding stage among the shift register without outputting the logical operation signals at the beginning of and at the end of the horizontal scanning period. With this arrangement, when seen from the path in which the pulse signals supplied by each stage of the shift register are branched, gate capacitance of an inverter circuit and a NAND signal can be substantially matched.

Further, an electronic apparatus according to the present invention comprises the electro-optical device as a display unit, so that degradation of image quality can be undetective.

DETAILED DESCRIPTION OF EMBODIMENTS

Figure 1:
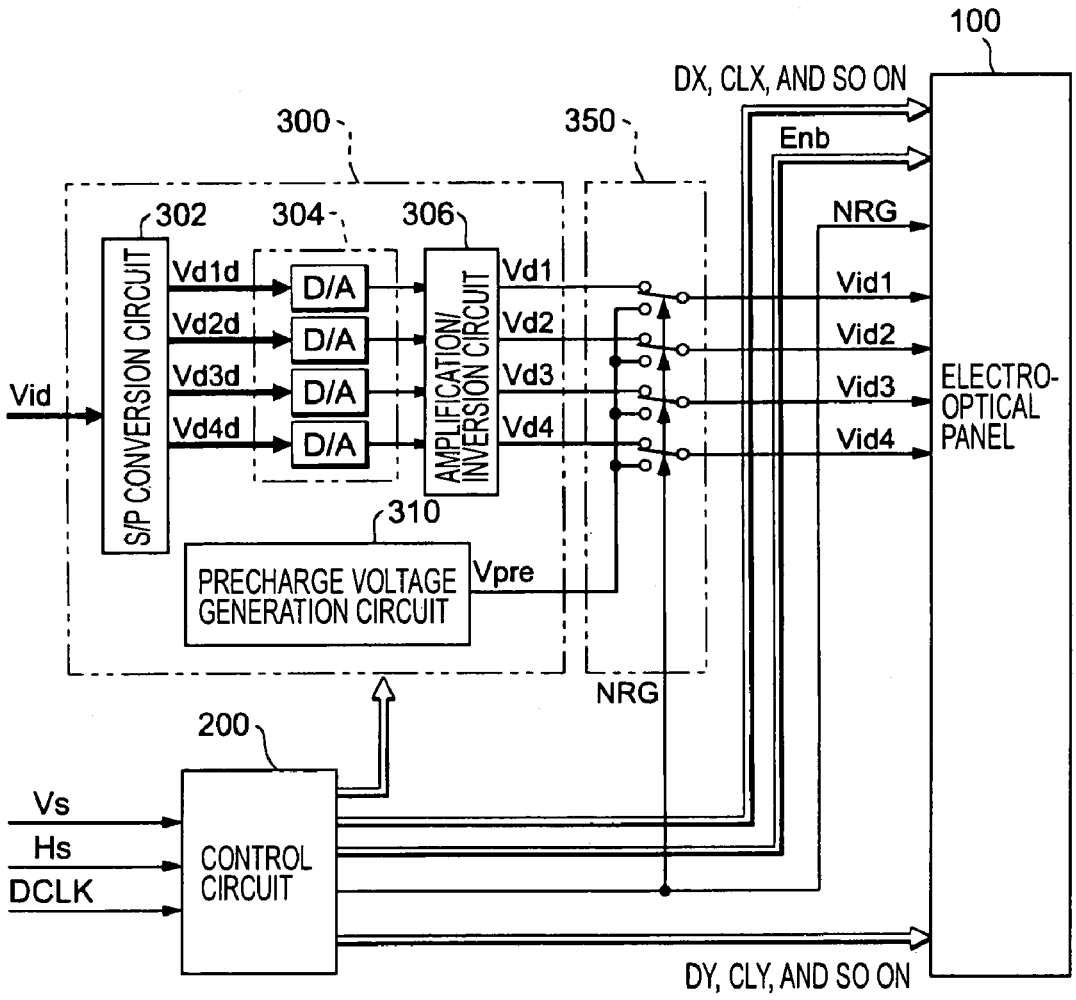
FIG. 1 is a block diagram showing an arrangement of an electro-optical device according to an embodiment of the present invention.

Hereinafter, an exemplary embodiment of the present invention will be described with reference to the attached drawings. FIG. 1 is a block diagram showing an overall arrangement of an electro-optical device according to an embodiment of the present invention.

As shown in FIG. 1, the electro-optical device comprises an electro-optical panel 100, a control circuit 200, and a processing circuit 300.

Among these, the control circuit 200 generates a timing signal or a clock signal for controlling each unit according to a vertical scanning signal Vs, a horizontal scanning signal Hs, and a dot clock signal DCLK, supplied from a higher-level device (not shown).

Further, the processing circuit 300 comprises an S/P conversion circuit 302, a plurality of D/A converters 304, and an amplification/inversion circuit 306.

Figure 5:
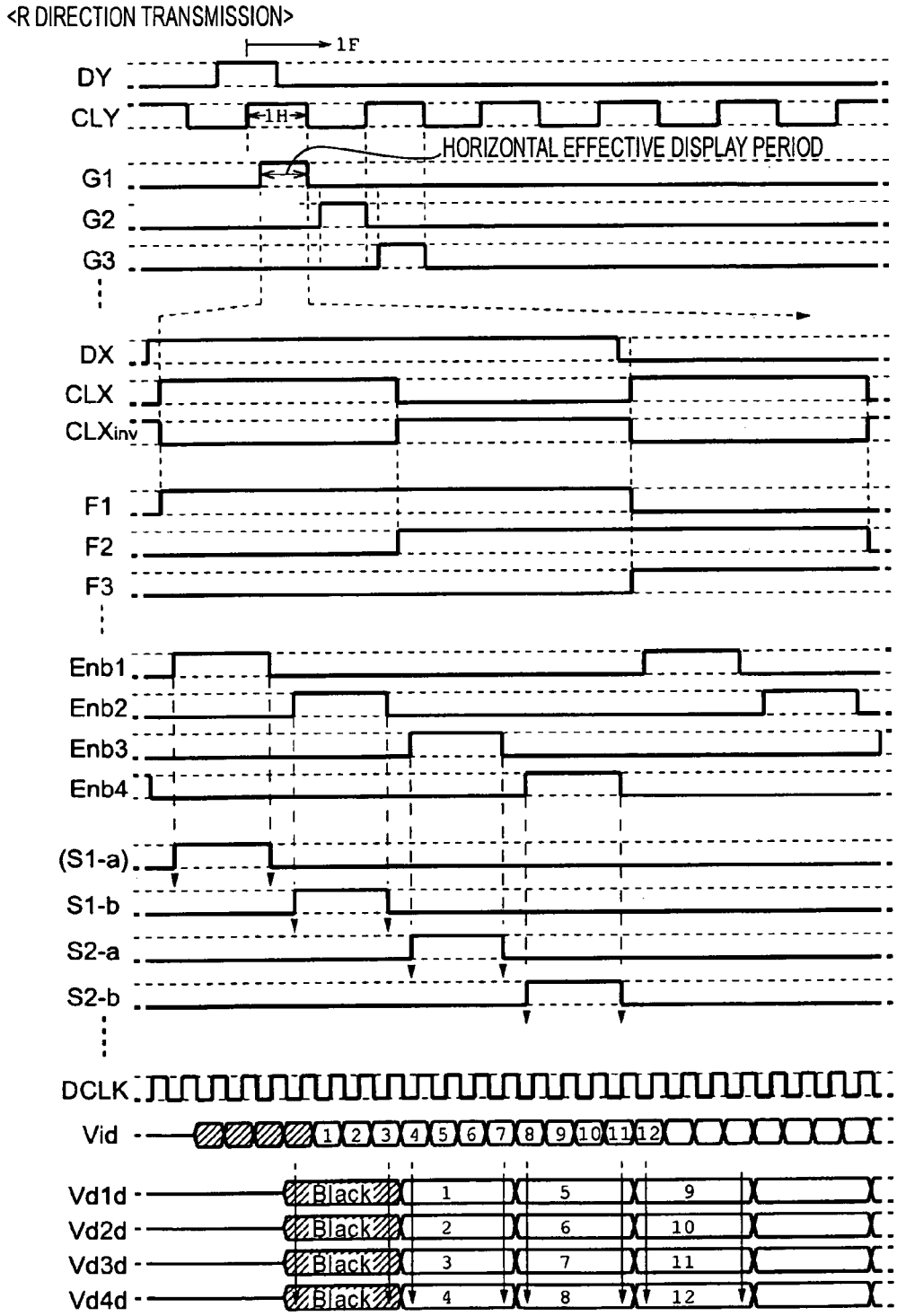
FIG. 5 is a timing chart showing the operation of the electro-optical device shown in FIG. 1.

Among these, the S/P conversion circuit 302 distributes image data Vid that designate the gray levels (brightness) of the pixels supplied in series from the higher-level device as a digital value for each pixel in synchronization with the vertical scanning signal Vs, the horizontal scanning signal Hs, and the dot clock signal DCLK, into 4 systems, or channels ch1 to ch4, and extends the image data Vid by four times along the time axis (S/P conversion) to output them as image data Vd1*d* to Vd4*d*, as shown in FIG. 5. Therefore, when the image data for one pixel is supplied for one period of the dot clock signal DCLX, the extended image data Vd1*d* to Vd4*d* are respectively supplied through 4 periods of dot clocks DCLK. In addition, the serial-parallel conversion (S/P conversion) is performed to extend the time for which the image signals are applied and obtain a sample and hold time and a sufficient charging and discharging time for the sampling switch, described below.

In addition, according to the present embodiment, the S/P conversion circuit 302 outputs image data to blacken the pixels, for example, in synchronization with a selection time of the image belonging to a dummy pixel region described below.

The D/A converters 304 are D/A converters arranged for each channel ch1 to ch4, and the image data Vd1*d* to Vd4*d* convert voltages corresponding to the gray-scale levels of the respective pixels into analog image signals.

The amplification/inversion circuit 306 inverts or noninverts a polarity of the analog converted image signals using the voltage Vc as a basis, and then, amplifies and supplies them as the image signals Vd1 to Vd4 in an appropriate manner. Here, while the polarity inversion can be performed in various aspects such as those (a) for every scanning line, (b) for every data line, (c) for every pixel, and (d) for every plane (frame), an embodiment of the present invention employs polarity inversion (a) for every scanning line. However, the present invention is not limited thereto.

Figure 6:
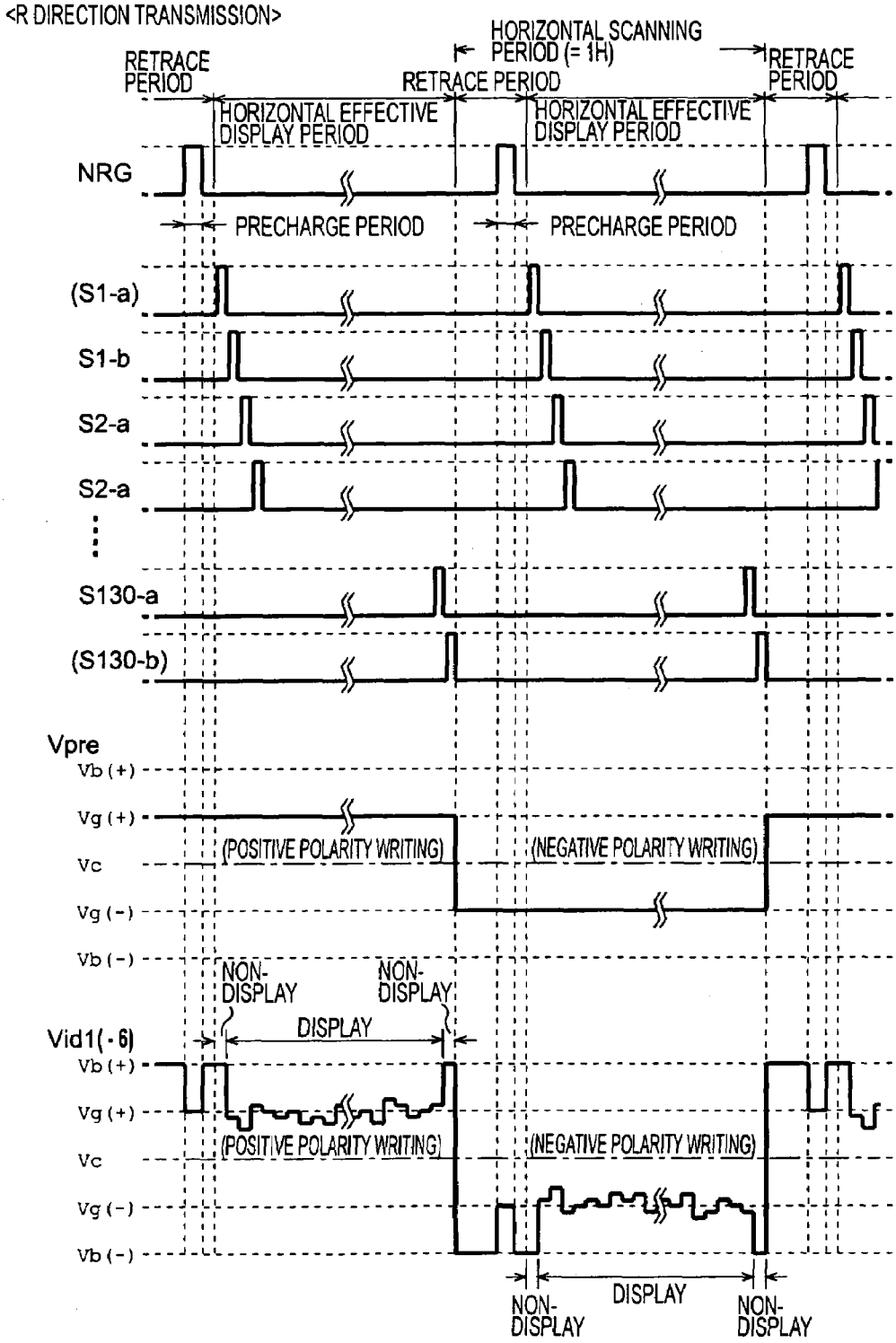
FIG. 6 is a timing chart showing the operation of the electro-optical device shown in FIG. 1.

In addition, the voltage Vc is an amplitude center voltage of an image signal, as shown in FIG. 6, and is roughly the same as a voltage LCcom applied to a counter electrode. Further, according to an embodiment of the present invention, for the sake of convenience, a voltage higher than the amplitude center voltage is referred to as a positive voltage, and a voltage lower than the amplitude center voltage is referred to as a negative voltage.

A precharge voltage generation circuit 310 generates a voltage signal Vpre for precharging, for a retrace period immediately prior to sampling the image signals into the data lines. In addition, according to an embodiment of the present invention, a graying voltage (gray-like voltage) that is an intermediate value between the highest gray-scale level, or white, and the lowest gray-scale, or black, is used as a precharge voltage signal Vpre.

As described above, according to an embodiment of the present invention, the polarity is inverted every scanning line, so that, in one horizontal scanning period, positive polarity writing and negative polarity writing are alternatively performed for every one horizontal scanning period. For this reason, the precharge voltage generation circuit 310 inverts and generates the precharge voltage signal Vpre for every one horizontal scanning period to be a positive gray-like voltage Vg(+) for a retrace period immediately prior to the positive polarity writing, or to be a negative gray-like voltage Vg(−) for a retrace period immediately prior to the negative polarity writing, as shown in FIG. 6.

Returning back to FIG. 1, a selector 350 selects the image signals Vd1 to Vd4 by using the amplification/inversion circuit 306 when a signal NRG is at the L level, for example, while selecting the precharge voltage signal Vpre by using the precharge voltage generation circuit 310 when a signal NRG is at the H level, so that each selected signal is supplied to the electro-optical panel 100 as Vid1 to Vid4. Here, the signal NRG is supplied from the control circuit, and is a signal that is at the H level for a precharge period or a portion of the retrace period.

Therefore, the signals Vid1 to Vid4 become the precharge voltage signal Vpre for a precharge time where the signal NRG is at the H level, and become the image signals Vd1 to Vd4, respectively, for other periods.

Figure 2:
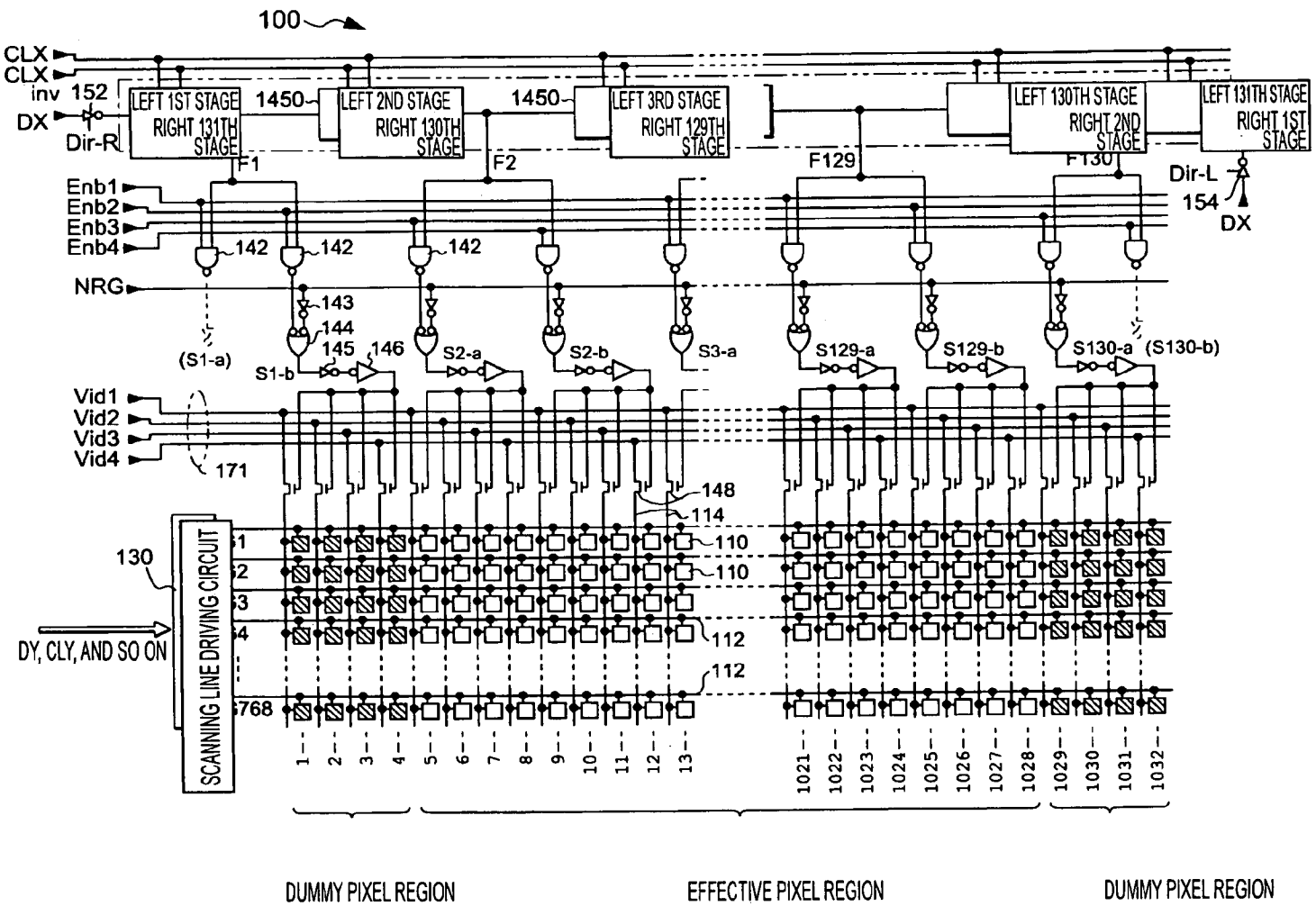
FIG. 2 is a block diagram showing an arrangement of an electro-optical panel for the electro-optical device shown in FIG. 1.

Next, a detailed arrangement of the electro-optical panel 100 will be described. FIG. 2 is a block diagram showing an electrical arrangement of the electro-optical panel 100. The electro-optical panel 100 is a liquid crystal panel in which an element substrate and a counter substrate, on which counter electrodes are provided, are attached with a gap therebetween, and liquid crystal is sealed into the gap.

In the electro-optical panel 100, as shown in FIG. 2, 768 scanning lines 112 are horizontally extended in the drawing, while 1032 (4×258) data lines 114 are vertically extended in the drawing. Further, pixels 110 are arranged at intersections between the scanning lines 112 and the data lines 114. Here, the pixels 110 are arranged in a matrix of 768 rows and 1032 columns. However, according to an embodiment of the present invention, the leftmost four columns and the rightmost four columns in the pixel arrangements that do not contribute to the display are used as dummy pixel regions. For this reason, according to an embodiment of the present invention, a display contributing region or an effective pixel region is 768 rows and 1024 columns corresponding to a region excluding the four leftmost columns and the four rightmost columns.

Next, a detailed arrangement of the pixel 110 will be described with reference to FIG. 3.

Figure 3:
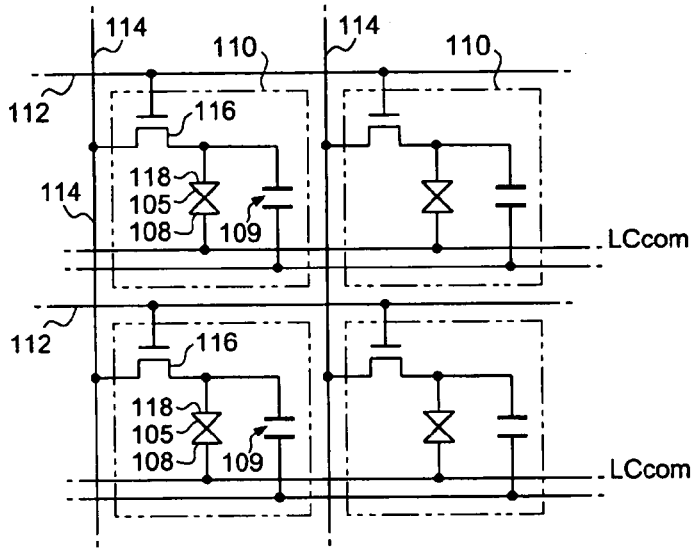
FIG. 3 is a diagram showing an arrangement of a pixel for the electro-optical panel shown in FIG. 2.

As shown in FIG. 3, for the pixel 110, an N-channel TFT (thin film transistor) 116 has a source connected to a data line 114, a drain connected the pixel electrode 118, and a gate connected to the scanning line.

In addition, the counter electrode 108 is commonly arranged for all pixels to face the pixel electrode 118, and a liquid crystal layer 105 is interposed between the pixel electrode 118 and the counter electrode 108. For this reason, a liquid crystal capacitor comprises the pixel electrode 118, the counter electrode 108, and the liquid crystal layer 105, for each pixel.

In addition, though not specifically shown, on each facing surface of both substrates, a rubbing-processed alignment film is arranged such that a long axis direction of the liquid crystal molecules are tilted, for example, about 90 degrees between both substrates, while a polarizer is arranged on each opposing side of both substrates, according to the direction of alignment.

Light transmitted between the pixel electrode 118 and the counter electrode 108 is rotated about 90 degrees as the liquid crystal molecules are tilted when the effective voltage of the liquid crystal capacitance is zero, while the liquid crystal molecules are tilted in the direction of an electric field as the applied the effective voltage grows. As a result, optical rotation disappears. Therefore, for a transmissive type, in the case of a normally white mode in which polarizers having polarizing axes corresponding to the alignment direction are arranged on the incident side and the opposing side, when the effective voltage of the liquid crystal capacitor is zero, the light transmittance becomes the maximum to perform white display, whereas, as the effective voltage grows larger, the amount of light is reduced, resulting in the minimum transmission or black display.

In addition, to prevent charge leakage in the liquid crystal capacitor, a storage capacitor 109 is arranged for every pixel. One end of the storage capacitor 109 is connected to the pixel electrode 118 (drain of the TFT 116), while the other end thereof is commonly grounded through all pixels.

Referring still to FIG. 3, around the effective pixel region and the dummy pixel region, peripheral circuits, such as a scanning line driving circuit 130 or a shift register 140, are arranged. Among these, the scanning line driving circuit 130 supplies scanning signals G1, G2, G3, . . . , and G768 that are at the L level only for one horizontal effective display period one after another to 1st, 2nd, 3rd, . . . , and 768th rows of the scanning lines, respectively, as shown in FIG. 5. In addition, a detailed description on the scanning line driving circuit 130 is omitted since it is not relevant to the present invention, but the scanning line driving circuit 130 has an arrangement such that a waveform shaping process is performed, for example, a transmission start pulse DY first supplied in one vertical scanning period IF is shifted each time a level of a clock signal CLY transits (up or down), and then, reduces the pulse width to be output as the scanning signals G1, G2, G3, . . . , and G768.

Next, the shift register 140 refers to 131 stages of latch circuits 1450 connected in parallel, for transmitting the transmission start pulses DX one after another, according to a clock signal CLX having a duty ratio of almost 50%, and a clock signal CLXinv having a logical inversion relationship with respect to the clock signal CLX. Here, the transmission start pulse DX is supplied at the start time of one horizontal scanning period, referring to a signal having a pulse width (a period for an H level) of almost one period of the clock signal CLX.

A shift register 140 has an arrangement such that the transmission start pulse can be transmitted either in the right direction (R direction or clockwise direction) or in the left direction (L direction or counterclockwise direction). Signals Dir-R, Dir-L, having logic levels exclusive with each other designate the transmission direction, and transmission in the R direction is indicated when the signal Dir-R is at the H level (when the signal Dir-L is at the L level) while transmission in the L direction is indicated when the signal Dir-L is at the H level (when the signal Dir-R is at the L level).

In the R direction transmission, the latch circuit 1450 uses the left end as an input and the right end as an output. Thus, in the latch circuit 1450, the left 1st stage, left 2nd stage, . . . , and left 130th stage, and left 131st stage are represented from the left of the drawing one after another. In the R direction transmission, the signals F1, F2, . . . , F130 are output from the left 1st stage, left 2nd stage, . . . , left 130th stage of the latch circuit 1450, respectively.

In contrast, in the L direction transmission, the latch circuit 1450 uses the right end as an input and the left end as an output. Thus, in the latch circuit 1450, the right 1st stage, right 2nd stage, . . . , and right 130th stage, and right 131st stage are represented from the left of the drawing one after another. In the L direction transmission, the signals F130, F129, . . . , F1 are output from the right 1st stage, right 2nd stage, . . . , right 130th stage of the latch circuit 1450, respectively.

In addition, the left 2nd stage of the latch circuit 1450 is the same as the right 130th stage of the latch circuit 1450, for example. Therefore, according to an embodiment of the present invention, if a stage is an even numbered stage in the R direction transmission (counting from the left), the stage is an even numbered stage in an odd numbered stage between and the L direction transmission (counting from the right), and likewise, if a stage is an odd numbered stage in the R direction transmission (counting from the left), the stage is an odd numbered stage in an odd numbered stage between and the L direction transmission (counting from the right).

A clocked inverter 152 supplies the transmission start pulse DX as an input to the left 1st stage of the latch circuit 1450 only in the R direction transmission where the signal Dir-R is at the H level. Further, a clocked inverter 154 supplies the transmission start pulse DX as an input to the right 1st stage of the latch circuit 1450 only in the L direction transmission where the signal Dir-L is at the H level.

Figure 4:
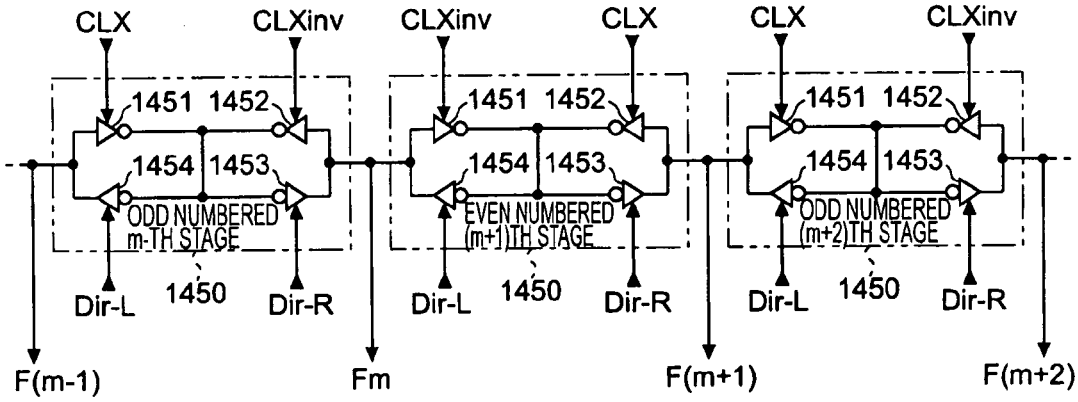
FIG. 4 is a diagram showing an arrangement of a shift register for the electro-optical device shown in FIG. 1.

Here, the latch circuit 1450 of the shift register 140 will be described in detail with reference to FIG. 4. FIG. 4 is a diagram showing an arrangement comprising three stages, or an odd numbered mth stage of the latch circuit 1450, an even numbered (m+1)th stage of the latch circuit 1450, and an odd numbered (m+2)th stage of the latch circuit 1450.

Every latch circuit 1450 has four clocked inverters 1451 to 1454. Among these, for the odd numbered stage of the latch circuit 1450, the clocked inverter 1451 inverts a logic level of the input signal when the clock signal CLX is at the H level, and makes the output a high impedance when the clock signal CLX is at the L level, while the clocked inverter 1452 inverts a logic level of the input signal when the clock signal CLXinv is at the H level, and makes the output a high impedance when the clock signal CLXinv is at the L level. Further, the clocked inverter 1453 inverts a logic level of the input signal when the clock signal Dir-R is at the H level, and makes the output a high impedance when the clock signal Dir-R is at the L level, while the clocked inverter 1454 inverts a logic level of the input signal when the clock signal Dir-L is at the H level, and makes the output a high impedance when the clock signal Dir-L is at the L level.

For the even numbered stage of the latch circuit 1450, it is opposite to the odd numbered one in terms of the supply relation between the clocked inverters 1451 and 1452 and the clock signals CLX and CLXinv. For this reason, for the even numbered stage of the latch circuit 1450, the clocked inverter 1451 inverts a logic level of the input signal when the clock signal CLXinv is at the H level, and makes the output a high impedance when the clock signal CLXinv is at the L level, while the clocked inverter 1452 inverts a logic level of the input signal when the clock signal CLX is at the H level, and makes the output a high impedance when the clock signal CLX is at the L level. In addition, the clocked inverters 1453 and 1454 do not have any difference between the odd numbered stage and the even numbered stage.

The shift register 140 has an arrangement in which the odd numbered stage of the latch circuit 1450 and the even numbered stage of the latch circuit 1450 are alternately connected.

With the arrangement described above, in the R direction transmission, the output of the clocked inverter 1454 is a high impedance throughout all stages, so that it is electrically negligible, while the clocked inverter 1453 is a simple NOT circuit.

First, when the clock signal CLX is at the H level, for the odd numbered stage of the latch circuit 1450, the clocked inverter 1451 inverts a logic level of the input signal from the left end and supplies the logic level to the input stage of the clocked inverter 1453, and the clocked inverter 1453 re-inverts the logical level of the signal supplied to the input stage to supply it to input stage of the clocked inverter 1452 along with the output signal from the latch circuit 1450. Here, when the clock signal CLX is at the H level, the output of the clocked inverter 1452 for the odd numbered stage becomes a high impedance state. Therefore, when the clock signal CLX is at the H level, the output of the clocked inverter 1453 or the output signal of the odd numbered stage is designated based only on the output level of the clocked inverter 1451. Thus, in the R direction transmission, when the clock signal CLX is at the H level (the clock signal CLXinv is at the L level), the signal Fm output from the odd numbered stage of the latch circuit 1450 is a noninverted signal obtained by repeating the logic inversion of the input signal at the left end twice.

Next, when the clock signal CLX is at the L level and the clock signal CLXinv is at the H level, for the odd numbered stage of the latch circuit 1450, the clocked inverter 1452 inverts the logic level of the output signal by the clock inverter 1453 and feeds it back to the clocked inverter 1453. In addition, for a period when the clock signal CLXinv is at the H level, the output of the clocked inverter 1451 for the odd numbered stage is high impedance. Therefore, in the R direction transmission, when the clock signal CLX is at the L level (clock signal CLXinv is at the H level), the signal Fm output from the odd numbered mth stage of the latch circuit 1450 is a latched one output from the clocked inverter 1453 immediately before the clock signal CLX is at the L level.

For the even numbered stage of the latch circuit 1450, it should be noted that the supply relation between the clocked inverters 1451 and 1452 and the clock signals CLX and CLXinv is opposite the odd numbered one. Thus, in the R direction transmission, when the clock signal CLX is at the L level, a signal F(m+1) output from the even numbered (m+1)th stage of the latch circuit 1450 becomes a positive signal twice logically inverted from the input signal of the left end, or the signal latched by one stage before the odd numbered mth stage of the latch circuit 1450.

In addition, in the R direction transmission, the signal F(m+1) output when the clock signal CLX is at the H level is a signal obtained by latching the output from the clocked inverter 1453 immediately before the clock signal CLX is at the H level.

Therefore, in the R direction transmission, the signal F(m+1) output from the even numbered (m+1)th stage of the latch circuit 1450 is a half-period-delayed one of the clock signal CLX (clock signal CLXinv) compared to the signal Fm output from the previous stage, or the odd numbered mth stage of the latch circuit 1450.

The shift register 140 has an arrangement in which these odd numbered stages and even numbered stages of the latch circuit 1450 are alternately connected. Thus, in the R direction transmission, when the transmission start pulse DX is supplied to the left 1st stage of the latch circuit 1450 as an input, the signals F1, F2, F3, . . . output from the left 1st stage, left 2nd stage, left 3rd stage, . . . will be as shown in FIG. 5. In other words, the first signal F1 is a signal obtained by normally outputting the transmission start pulse DX when the clock signal CLX is at the H level, and is a signal obtained by latching the immediately previous normal output when the clock signal CLX is at the L level. The second signal F2 is a normal signal of a signal latched by the left 1st stage of the latch circuit when the clock signal CLX is at the L level, and is a signal obtained by latching the immediately previous normal output when the clock signal CLX is at the H level, and the following signals are repeated in the same manner. Therefore, the signals F1, F2, F3, . . . , and F130 are shifted one after another by a half period of the clock signal CLX (clock signal CLXinv).

In addition, in the L direction transmission, the output of the clocked inverter 1453 is a high impedance throughout all stages, so that it is electrically negligible, while the clocked inverter 1454 is a simple NOT circuit. For this reason, at the odd numbered (m+2)th stage of the latch circuit 1450, when the clock signal CLX is at the L level, the clocked inverter 1452 inverts the logic level of the signal input from the right end to supply it to the input stage of the clocked inverter 1454, and the clocked inverter 1454 re-inverts the logic level of the signal supplied to the input stage to supply it to the input stage of the clocked inverter 1451, where the output is a high impedance, as well as to outputting it as a signal F(m+1). Therefore, in the L direction transmission, the signal F(m+1) output when the clock CLK is at the L level becomes a normal signal obtained by repeating the logical inversion of the input signal at the right end twice.

For the odd numbered (m+2)th stage of the latch circuit 1450, when the clock signal CLX is at the H level, the clocked inverter 1451 inverts the logic level of the signal output by the clock inverter 1454 to feed it back to the given clocked inverter 1454. Therefore, in the L direction transmission, the signal F(m+1) output when the clock signal CLX is at the H level is a latched one output from the odd numbered (m+2)th stage of the clocked inverter 1454 immediately before the clock signal CLX is at the H level.

Moreover, in the L direction transmission, when the clock signal CLX is at the H level, the signal Fm output from the even numbered (m+1)th stage of the latch circuit 1450 is a noninverted signal obtained by repeating the logical inversion of the input signal at the right end twice, that is, a signal latched by the odd numbered (m+2)th stage of the latch circuit 1450.

Next, in the L direction transmission, the signal Fm output when the clock signal CLX is at the L level is a latched one output from the clocked inverter 1454 of the even numbered (m+1)th stage immediately before the clock signal CLX is at the L level.

Figure 7:
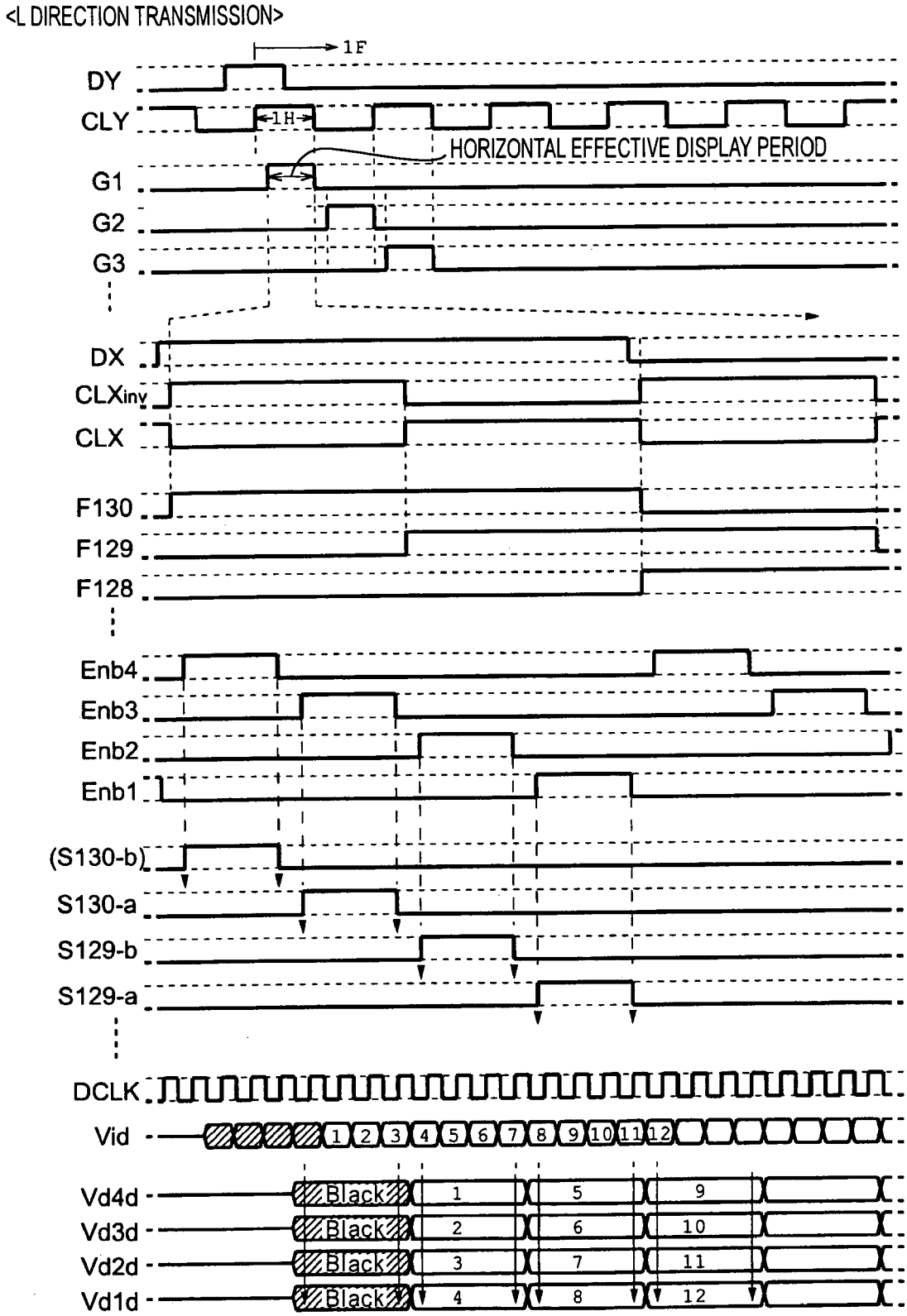
FIG. 7 is a timing chart showing the operation of the electro-optical device shown in FIG. 1.

Therefore, in the L direction transmission, when the transmission start pulse DX is supplied to the right 1st stage of the latch circuit 1450 as an input, the signals F130, F129, F128 . . . output from the right 1st stage, right 2nd stage, right 3rd stage, . . . of the latch circuit 1450 are as shown FIG. 7. In other words, the first signal F130 is a signal obtained normally outputting the transmission start pulse DX when the clock signal CLX is at the L level, and is a signal obtained by latching the immediately previous noninverted output when the clock signal CLX is at the H level. The second signal F129 is a signal latched by the right 1st stage of the latch circuit when the clock signal CLX is at the H level, and is a signal obtained by latching the immediately previous noninverted output when the clock signal CLX is at the L level, and the following signals are repeated in the same manner. Therefore, the signals F130, F129, F128, . . . , and F1 are sequentially shifted by a half period of the clock signal CLX (clock signal CLXinv).

In addition, in FIG. 4, to aid understanding of the description, a complementary arrangement is omitted. Specifically, the clocked inverters 1451, 1452, 1453, and 1454 are well known, each of which comprises two complementary P-channel TFTs and two N-channel TFTs connected in series in a range from the high level voltage Vdd to the low level voltage Vss of the power supply.

Therefore, for example, the clock signal CLX shown in FIG. 4, as well as the clock signal CLXinv (not shown), is supplied to the odd numbered stage of the clocked inverter 1451, for example. Similarly, for example, the signal Dir-R shown in FIG. 4, as well as the signal Dir-L (not shown), is supplied to the clocked inverter 1453.

Referring back to FIG. 2, each signal path of the signals F1, F2, . . . , and F130 output from the shift register 1450 is branched into two, or the right and left directions in FIG. 2, respectively, and in principle, an operation circuit comprising a NAND circuit 142, a NOT circuit 143, a NAND circuit 144, and NOT circuits 145 and 146 is arranged after each branched path. However, for a left-branched path of two branches of the signal F1 path, and a right-branched path of the two branches of the signal F130 path, as an exception, only the NAND circuit 142 is provided.

Here, among supply paths of the signal Fm, where m is an odd number, i.e., the signal output from the odd numbered stage of the latch circuit 1450 in the R direction transmission (signal output from the even numbered stage of the latch circuit 1450 in the L direction transmission), the NAND circuit 142 corresponding to the left-branched path of FIG. 2 outputs a NAND signal of the given signal Fm and the enable signal Enb1, while the NAND circuit 142 corresponding to the right-branched path outputs a NAND signal of the given signal Fm and the enable signal Enb2.

In addition, among the signal Fm, where (m+1) is an even number, i.e., the signal output from the even numbered stage of the latch circuit 1450 in the R direction transmission (signal output from the odd numbered stage of the latch circuit 1450 in the L direction transmission), the NAND circuit 142 corresponding to the left-branched path of FIG. 2 outputs a NAND signal of the given signal F(m+1) and the enable signal Enb3, while the NAND circuit 142 corresponding to the right-branched path outputs a NAND signal of the given signal F(m+1) and the enable signal Enb4.

Here, for the enable signals Enb1 to Enb4, the periods of the pulse widths for the H level are substantially the same, as shown in FIG. 5, and are not overlapped with each other. Further, phases thereof are shifted by 90 degrees with respect to each other. Furthermore, in the R direction transmission, pulses of the enable signals Enb1 and Enb2 are output one after another when the clock signal CLX is at the H level, and pulses of the enable signals Enb3 and Enb4 are output in order when the clock signal CLKinv is at the H level.

The NAND circuit 144 outputs a NAND operated signal between a signal NAND operated by the NAND circuit 142 and a signal inverted from the signal NRG by the NOT circuit 143. The NOR operated signal by the NOR circuit 144 is output as a sampling signal via logical inversion an even number of times (twice in FIG. 2) by the NOT circuits 145 and 146.

Here, among the output paths of the signals F1, F2, F3, . . . , and F130, the sampling signals output through the left-branched path are referred to as S1-*a*, S2-*a*, S3-*a*, . . ., and S130-*a*, and the sampling signals output through the right-branched path are referred to as S1-*b*, S2-*b*, S3-*b*, . . . , and S130-*b*.

In addition, for the left-branched path of the two branches of the signal F1 and for the right-branched path of the two branches of the signal F130, only the NAND circuit 142 is arranged. Therefore, in fact, although the sampling signals S1-*a* and S130-*b* have nothing to output, the output signal of the given NAND circuit 142 is regarded as a virtual signal when inverted by the NOT circuit, as shown in dotted lines.

The sampling switch 148 is, for example, an N-channel TFT, and is provided to every data line 114. The sampling switch 148 samples the respective signals Vid1 to Vid4 of four channels supplied through four image signal lines 171 into the data lines 114.

Specifically, for the sampling switch 148 in which a drain is connected to one end of the jth data line 114 counting from the left side of FIG. 2, when the remainder after dividing j by 4 is '1', the source is connected to the image signal line 171 to which the signal Vid1 is supplied. Similarly, for the sampling 148 in which a drain is connected to the data line 114 when the remainder after dividing j by 4 is '2', '3', and '0', respectively, the source is connected to the image signal line 171 to which the signal Vid2 to Vid4 is supplied. For example, the source of the sampling switching in which a drain is connected to the eleventh data line 114 counting from the left side of FIG. 2 is connected to the image signal line 171 to which the signal Vid3 is supplied since the remainder after dividing '11' by 4 is '3'.

Moreover, the gate of the four sampling switches 148 in which a drain is connected to the data line 114 where the quotient after dividing (j+3) by 8 is 'i' and the remainder is '0' to '3' is commonly supplied to each sampling signal S(i+1)*a*, and the gate of the four sampling switches 148 in which a drain is connected to the data line 114 where the remainder is '4' to '7' is commonly supplied to each sampling signal S(i+1)*b*.

For example, the fifth to eighth data lines 114 have (j+3) of '8' to '11', and the quotient after dividing this number by 8 is '1', and the remainder is '0'to '3', respectively, so that the gate of the sampling switch 148 corresponding to the data line 114 is commonly supplied with the sampling signal S2-*a*. In addition, for example, the 1025th to 1028th data lines 114 have (j+3) of '1028' to '1031', and the quotient that divides this number into 8 is '128', and the remainder is '4' to '7', respectively, so that the gate of the sampling switch 148 corresponding to the data line 114 is commonly supplied with the sampling signal S129-*b*.

In addition, according to an embodiment of the present invention, four data lines 114 having a relation such that the same sampling signal is supplied to the gate of the corresponding sampling switch 148 are regarded as a block.

Next, the operation of the electro-optical device according to the embodiment will be illustrated in the context of the R direction transmission. FIGS. 5 and 6 are timing charts for illustrating the operation of an electro-optical device in the R direction transmission.

First, for a first horizontal scanning period IF, a transmission start pulse DY is supplied to a scanning line driving circuit 130. With this, the scanning signals G1, G2, G3, . . . , and G768 are at the H level exclusively only for the horizontal effective display period, as shown in FIG. 5.

Here, with respect to the horizontal effective display period in which the scanning signal GI is at the H level, for a retrace period prior to the given horizontal effective display period, the signal NRG is at the H level for a precharge period isolated from the front and back end of the retrace period, as shown in FIG. 6. For the horizontal effective display period, in the case of the positive polarity writing, the precharge voltage generation circuit 310 makes a precharge voltage signal Vpre a voltage Vg(+) corresponding to the positive polarity writing.

When the signal NRG is at the H level, a selector 350 (ref. FIG. 1) selects the precharge voltage signal Vpre, so that four image signal lines 171 are a voltage Vg(+) corresponding to the positive polarity writing for the immediately following the horizontal effective display period.

In addition, when the signal NRG is at the H level, irrespective of the level NAND operated by the NAND circuit 142, the NAND signal output by the NAND circuit 144 is forced to be the H level, so that all sampling switches 148 are turned on. Therefore, when the signal NRG is at the H level, the voltage signal Vpre of the image signal line 171 is sampled so that all of the data lines 114 are precharged into Vg(+) as the pre-established positive polarity writing.

In addition, when the precharge period ends and the signal NRZ is at the L level, the NAND circuit 144 acts as a NOT circuit for inverting a logic level of the NAND signal output by the NAND circuit 142.

When the retrace period ends, the transmission start pulse DX is shifted by each latch circuit 1450 of the shift register 140, as shown in FIG. 5, and is output as the signals F1, F2, F3, . . . during a horizontal effective display period.

The pulse width of the left-branched signal of the odd numbered m signal Fm is reduced by performing a NAND operation of the left-branched signal and the enable signal Enb1 by the NAND circuit 142, and the NAND signal of the left-branched signal and the enable signal Enb1 is output as the sampling signal Sm-a via the NAND circuit 144 and the NOT circuits 145 and 146. In addition, the pulse width of the right-branched signal of the odd numbered m signal Fm is reduced by performing a NAND operation of the right-branched signal and the enable signal Enb2 by the NAND circuit 142, and the NAND signal of the right-branched signal and the enable signal Enb2 is output as the sampling signal Sm-b via the NAND circuit 144 and the NOT circuits 145 and 146.

Furthermore, the pulse width of the left-branched signal of the even numbered (m+1) signal F(m+1) is reduced by performing a NAND operation of the left-branched signal and the enable signal Enb3 by the NAND circuit 142, and the NAND signal of the left-branched signal and the enable signal Enb3 is output as the sampling signal S(m+1)–a via other circuits. Similarly, the pulse width of the right-branched signal of the even numbered (m+1) signal F(m+1) is reduced by performing a NAND operation of the right-branched signal and the enable signal Enb4 by the NAND circuit 142, and the NAND signal of the right-branched signal and the enable signal Enb4 is output as the sampling signal S(m+1)–b via other circuits.

Here, positive pulse widths (a period for the H level) of the enable signals Enb1 and Enb2 are included in the period where the clock signal CLX is at the H level, and positive pulse widths (a period for the H level) of the enable signals Enb3 and Enb4 are included in the period where the clock signal CLX is at the L level (clock signal CLXinv is at the H level), and at the same time, outputs such that the positive pulse widths are overlapped with each other. Thus, the sampling signals S1-*b*, S2-*a*, S2-*b*, . . . are output not to be overlapped, as shown in FIG. 5. In addition, the sampling signals S1-*a* and S130-*b* are virtual signals as described above.

Further, first, the image data Vid supplied in synchronization with the horizontal period are distributed into four channels by the S/P conversion circuit 302, and extended by four times along the time axis, and secondly, are converted into each analog signal by the D/A converters 304, and output normally using the voltage Vc as reference corresponding to the positive polarity writing. For this reason, the noninversed image signals Vd1 to Vd4 are at the H level voltage compared to the voltage Vc as the pixels are used as black ones.

In addition, for the horizontal effective display period, a signal NRG is at the L level. Thus, a selector 350 selects the applied image signals Vd1 to Vd4, so that the signals Vid1 to Vid4 supplied to four image signal lines 171 become image signals Vd1 to Vd4 by the amplification/inversion circuit 306.

In addition, in FIG. 6, among the signals supplied to four image signal lines 171, the voltage variation of the signal Vid1 corresponding to the channel ch1 is shown. For a retrace period, when the image signals Vd1 to Vd4 are black-like voltages Vb(+) or Vb(−) corresponding to the polarity, the signal Vid1 supplied to the image signal line 171 is some portion of the black-like voltage, and when the signal NRG is at the H level, the precharge voltage signal Vpre is provided so that the signal is gray-like voltages Vg(+) or Vg(−) corresponding to the immediately following writing polarity.

Further, for the horizontal effective display period where the scanning signal G1 is at the H level, the first sampling signal S1-*a* is at the H level. However, this signal is not supplied to the sampling switch 148, so that the sampling signal S1-*a* is not concerned in the display operation.

Next, when the sampling signal S1-*b* is at the H level, for each of the first to fourth data lines 114 counting from the left side of FIG. 2, each image signal Vd1 to Vd4 is sampled. In addition, the sampled image signals Vd1 to Vd4 are respectively applied to the pixel electrode 118 of the pixel 110 corresponding to the intersection between the first scanning line 112 and the first to fourth data lines 114 counting downwardly in FIG. 2.

However, the first to fourth data lines 114 belong to the dummy pixel region, so that the sampled image signals are black-like voltage Vb(+) in response to the positive polarity writing. For this reason, pixels in the range from the 1st row, 1st column to the 1st row, 4th column perform a black display.

Next, when the sampling signal S2-*a* is at the H level, at this time, for each of the fifth to eighth data lines 114, each image signal Vd1 to Vd4 is sampled. In addition, the sampled image signals are respectively applied to the pixel electrodes 118 of the pixels 110 corresponding to the intersections between the first-row scanning line 112 and the fifth to eighth data lines 114.

These fifth to eighth data lines 114 belong to the effective pixel region, and the sampled image signals are gray-scale levels indicated by the image data Vid, corresponding to the positive polarity writing. For this reason, the pixels in the range from the 1st row, 5th column to the 1st row, 8th column are in gray levels indicated by the image data Vid.

Therefore, according to an embodiment of the present invention, the effective pixels that contribute to display start from the fifth one.

Further, when the sampling signal S2-*b* is at the H level, at this time, for each of the ninth to twelfth data lines 114, each image signal Vd1 to Vd4 is sampled. In addition, the sampled image signals Vd1 to Vd4 are respectively applied to the pixel electrodes 118 of the pixels 110 corresponding to the intersections between the first-row scanning line 112 and the ninth to twelfth data lines 114. Thus, the pixels in the range from the 1st row, 9th column to the 1st row, 12th column are in gray levels indicated by the image data Vid.

Hereinafter, the same writing is repeated until the sampling signals S129-*b*, S130-*a*, and S130-*b* are at the H level, one after another, so that all writing for the first-row pixels is completed.

However, when the sampling signal S130-*a* is at the H level, the 1029th to 1032nd data lines belong to the dummy pixel region, so that the sampled image signals are at the black-like voltage Vb(+). For this reason, pixels in the range from the 1st row, 1029th column to the 1st row, 1032nd column are blackened. In addition, in the R direction transmission, the sampling signal S130-*b* is at the H level for the last transmission in one horizontal effective display period, but this signal is not supplied to the sampling switch 148. Therefore, the sampling signal S130-*b* is not concerned in the display operation. In other words, according to the present embodiment, the pixels that contribute to display end at the 1028th pixel.

Therefore, according to an embodiment of the present invention, the range of effective pixels contributing to display is from the 5th to 1028th columns, or 1024 columns.

When writing to all first-row pixels is completed, the scanning signal G1 is at the L level. When the scanning signal G1 is at the L level, the TFT 116 connected to the first-row scanning line 112 turns off, but due to the storage capacitor 109 and the capacitance of the liquid crystal layer itself, the pixel electrode 118 is maintained at the voltage written at the 'on' time, so that the gray-scale level corresponding to the given retention voltage is retained.

Next, during the retrace periods immediately before the scanning signal G2 is at the H level, for a precharge period where the signal NRG becomes to the H level, four image signal lines 171 are supplied with the precharge voltage signal Vpre by the precharge voltage generation circuit 310, as described above. However, for the horizontal effective display period where the scanning signal G2 is at the H level, negative polarity writing is performed for the polarity inversion of every scanning line. Thus, all data lines 114 are precharged to the voltage Vg(−) in response to the negative polarity writing.

Other operations are the same as that for the period where the scanning signal is at the H level, and as the sampling signals S1-*a*, S1-*b*, S2-*a*, S2-*b*, . . . , and S130-*a*, S130-*b* are at the H level one after another, among the second-row pixels, pixels in the range from the 2nd row, 1st column to the 2nd row, 4th column are blackened, and writing for performing the effective display on the 2nd row, 5th column to the 2nd row, 1028th column is performed, and pixels in the range from the 2nd row, 1029th column to the 2nd row, 1032nd column are blackened.

Further, the amplification/inversion circuit 306 inverts the analog signal by the D/A converters 304 as a basis of the voltage Vc in response to each negative polarity writing, so that the signals Vid1 to Vid4 (Vd1 to Vd4) correspond to a voltage lower than the voltage Vc as the pixels are blackened (see FIG. 6).

Hereinafter, similarly, the scanning signals G3, G4, . . . , and G768 are at the H level and writing is performed on the pixels in the 3rd row, 4th row, . . . , 768th row. With this, positive polarity writing for the pixels in the odd numbered rows and negative polarity writing for the pixels in the even numbered rows are performed, and for this one vertical scanning period, writing into the 1 st to 768th rows of pixels is completed.

Further, for the next one vertical scanning period (1F), the same writing is performed, but this time, the writing polarity for each row of pixels can be interchanged. In other words, for the next one vertical scanning period, negative polarity writing for the pixels in the odd numbered rows and positive polarity writing for the pixels in the even numbered rows are performed. In this way, since the writing polarity into the pixels for each horizontal scanning period can be interchanged, applying a DC component to the liquid crystal is not required so that degradation of the liquid crystal can be prevented. In addition, with the exchanged writing polarity, the precharge voltage signal Vpre is also polarity-inverted.

Figure 8:
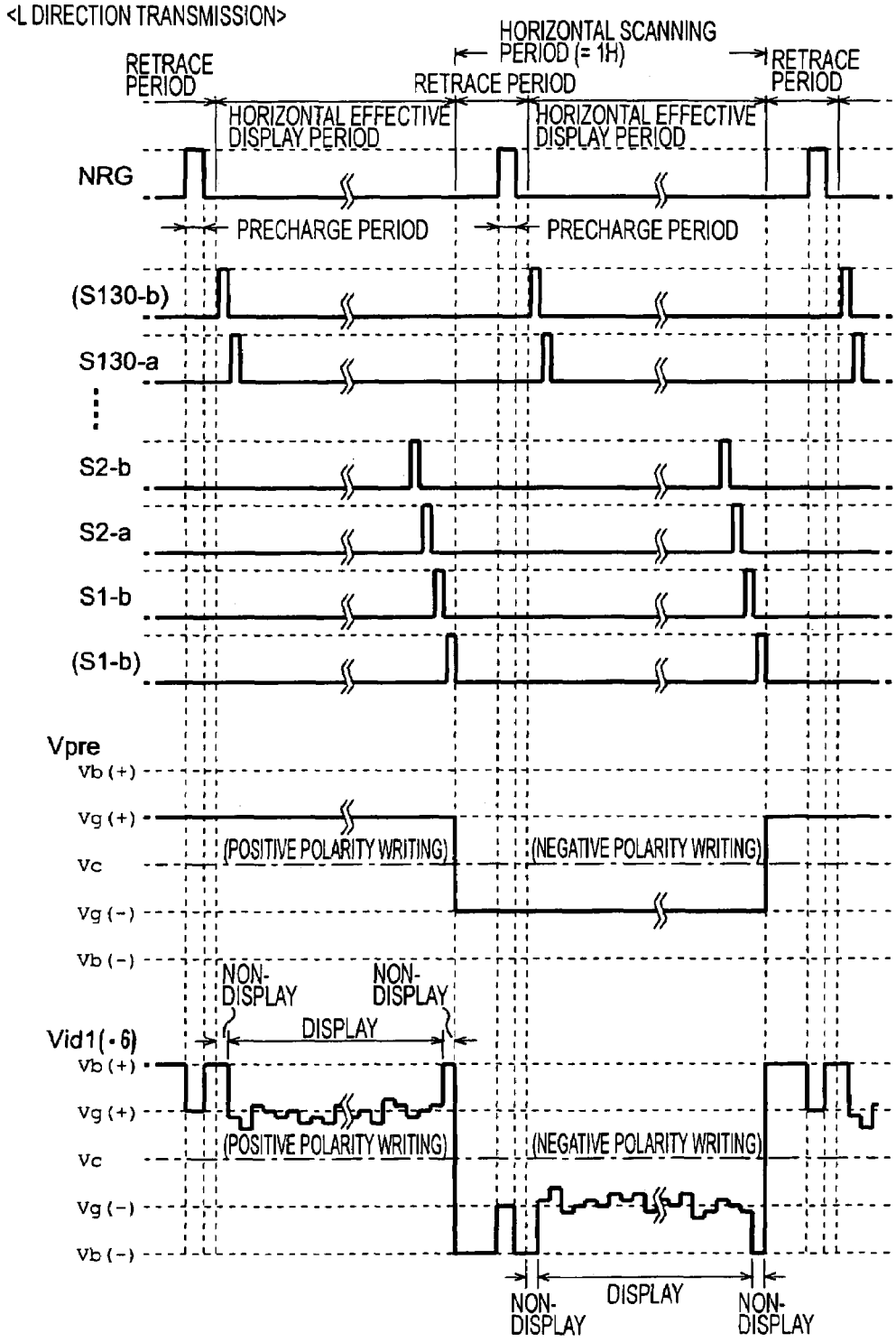
FIG. 8 is a timing chart showing the operation of the electro-optical device shown in FIG. 1.

In addition, operation of L direction transmission is shown in FIGS. 7 and 8, and the difference compared to the R direction transmission is that the sampling signals S130-*b*, S130-*a*, . . . , and S2-*b*, S2-*a*, S1-*b*, and S1-*a* are at the H level one after another, and the distribution sequence of the image signals Vd1 to Vd4 to the image signal line 171 is reversed since the connection relationship between the sampling switch 148 and the image signals line 171 are fixed in the block. In addition, a phase relation between the clock signals CLX and CLXinv and the enable signals Enb1 to Enb4 is also reversed, but this may be coped by interchanging the signal supply path.

In the present embodiment, for a path in which the output path of the signal F1 is branched in the left direction, and a path in which the output path of the signal F130 is branched in the right direction, only the NAND circuit 142 is provided, and sampling switches 148 are omitted after the NAND circuit and the data line 114. In addition, the range of effective pixels contributing to display is restricted to the 5th column to 1028th column, or 1024 columns. Here, the reason for and the effect of the restriction will now be described.

As described above, in the R direction transmission, the first half of the positive pulse (H level) in the signal F1 output at first from the shift register 140 is obtained by normally outputting the transmission start pulse DX when the clock signal CLX is at the H level, while the former part of the positive pulses in the signals F2, F3, . . . , and F130 are respectively obtained by normally outputting the signals latched by the latch circuits at the previous stages. In other words, in the R direction transmission, since there is no latch circuit at the stage before the latch circuit outputting the signal F1 to be positive pulse, the signal F1 is output with a different waveform under the different condition from those of other signals F2, F3, . . . , and F130.

Here, the signal F1 is branched into two paths, the left and right paths, and the branched signals of the signal F1 are supplied to the NAND circuits 142, respectively, to be the sampling signals S1-*a* and S1-*b*. When the image signals are sampled on the data lines 114 by the sampling signals S1-*a* and S1-*b*, 8 data lines 114 in which the image signals are sampled by the respective sampling signals S1-*a* and S1-*b* are provided in the present embodiment. The signal F1 as the original signals of the sampling signals S1-*a* and S1-*b* is different from other signals F2, F3, . . . , and F130, so that the image signals are sampled on the 8 data lines 114 described above in states different from those of the other data lines 114, and with this result, a large difference in display quality occurs.

As a method to remove the difference in the display quality, it will be appreciated that the pixels corresponding to the 8 data lines are designated to be the dummy pixel region that does not contribute to display. However, the present inventors came to the conclusion that when this method is used to attempt high definition display, a non-display region, which is wasteful, becomes excessively large. This is because the present embodiment uses an arrangement such that the image data is expanded onto 4 channels (4 dimensions) and the number of data lines on which the image signals are sampled at the same time is '4', but when an arrangement is provided in which the video data is expanded onto 32 channels (32 dimensions) and the number of data lines on which the image signals are sampled at the same time is '32', the pixel region corresponding to 64 data lines, twice compared to the above case, becomes at least the dummy pixel region. In addition, with a large non-display region, which is wasteful, the electro-optical panel 100 becomes correspondingly larger, so that the number into which one mother substrate can be cut is reduced, leading to high manufacturing costs.

In addition, due to capacitive coupling between the image signal line 171 and the counter electrode 108, capacitive coupling between the data line 114 and the counter electrode 108, and the resistance of the counter electrode 108, the voltage of the counter electrode 108 to be kept at the voltage LCcom may vary according to the voltage variation of the image signal line 171.

In the present embodiment, in the case of the R direction transmission for one horizontal scanning period, the image signals are sampled on the data line 114 in the sequence of the 1 st to 4th, the 5th to 8th, and the 9th to 12th lines, but for example, due to the voltage variation of the image signal line 171 when the 1 st to 4th data lines 114 are selected or the voltage variation of the data line 114 accompanying the sampling of the image signal, the voltage of the counter electrode 108 may be changed. In the state in which the voltage variation is not converged, when the image signals are sampled on the next lines, that is, 5th to 8th column data lines 114, the counter electrode 108 is not at the voltage LCcom even if the image signal is properly applied to the pixel electrodes 118 of the corresponding pixels. Therefore, the voltage retained in the liquid crystal capacitor does not become the predetermined value. This is also applicable to each group after a group of the 9th to 12th data lines, where the image signals are simultaneously sampled.

With respect to this, for the 1st to 4th data lines 114, there are no data lines 114 in which the image signals are sampled earlier, so that these are not affected by a voltage variation of the counter electrode 108. Therefore, there may be a display difference between pixels corresponding to the 1st to 4th data lines 114 and pixels corresponding to the 5th and the subsequent data lines 114 affected by the voltage variation.

First, according to the present embodiment, the sampling signal S1-*a* based on the left-branched signal of the signal F1 is not used. With this, four sampling switches 148 and four data lines can be omitted, and the ineffective region is accordingly reduced. Next, according to the present invention, an arrangement in which the sampling signal S1-*b* based on the right-branched signal of the signal F1 is used to sample the image signals on the 1st to 4th data lines 114 by the sampling switch 148 is provided. However, the pixels corresponding to the 1st to 4th data lines 114 are designated to be the dummy pixel region which does not contribute to display. With this, a display difference does not occur for pixels corresponding to the 5th and subsequent data lines 114 that receive a voltage variation of the counter electrode 108.

Therefore, according to the present embodiment, the sampling switches 148 turned on and off based on the sampling signal S1-*a* for branching the signal F1 to the left side, and the data lines 114 are omitted, and accordingly, the pixel region corresponding to the 1st to 4th data lines 114 in which the image signals are sampled based on the sampling signal S1-*b* branched to the right side is used as the dummy pixel region. Therefore, in the R direction transmission, a difference between the signal F1 output at first for one horizontal scanning period, and the other signals F2, . . . , and F130, and degradation of display quality due to the voltage variation of the counter electrode can be suppressed, and the non-display dummy pixel region can be reduced.

Further, in the L direction transmission, the first half of the positive pulse (H level) in the signal F130 output at first from the shift register 140 is obtained by normally outputting the transmission start pulse DX as it is for a period when the clock signal CLX is at the L level, while the former part of the positive pulses in the signals F129, F128, . . . , and F1 are respectively obtained by normally outputting the signals latched by the latch circuit at the previous stage. For this reason, the signal F130 is output with a different waveform under different the condition waveform from those of other signals F129, F128, . . . , and F1.

In addition, regarding a voltage variation of the counter electrode in the L direction transmission, there may be a display difference between pixels corresponding to the 1032nd to 1029th data lines 114 and pixels corresponding to the 1028th to 1st data lines 114 affected by the voltage variation of the counter electrode.

With this, according to the present embodiment, the sampling switches 148 turned on and off based on the sampling signal S130-*b* as the right-branched signal of the signal F130, and the data lines 114 are omitted, and accordingly, the pixel region corresponding to the 1032nd to 1029th data lines 114 in which the image signals are sampled based on the sampling signal S130-*a* as the left-branched signal of the signal F130 is used as the dummy pixel region. Therefore, in the L direction transmission, a difference between the signal F130 output at first for one horizontal scanning period and other signals F129, . . . , and F1, and degradation of display quality due to the voltage variation of the counter electrode can be suppressed, and the ineffective dummy pixel region can be reduced.

However, since the degradation of the display quality results from signals output at first from the shift register 140 for one horizontal scanning period and a voltage variation of the counter electrode, in the case of the R direction transmission, it will be appreciated that only the region corresponding to the 1st to 4th data lines is designated to be the dummy pixel region, and so the pixel region of the 1029th to 1032nd data lines at the opposite side is not necessarily used as the dummy pixel region.

Similarly, in the L direction transmission, it will be appreciated that only the region corresponding to the 1032nd to 1029th data lines is designated to be the dummy pixel region, and so the pixel region of the 4th to 1st data lines is not necessarily used as the dummy pixel region.

However, as described below, with a three-panel type projector corresponding to RGB, when images corresponding to the respective colors are formed with three electro-optical panels, it is necessary to form a normal image for one color and a left-right inverted image for another color and to combine and to project them.

In this case, when dedicated electro-optical panels are provided for the normal image and the left-right inverted image, high manufacturing costs are required. Thus, it is advantageous to arrange one electro-optical panel available for both the normal image and the left-right inverted image.

However, with the arrangement described above, in case of the R direction transmission for forming the normal image, only the region corresponding to the 1st to 4th data lines is used as the dummy pixel region, while in case of the L direction transmission for forming the left-right inverted image, only the region corresponding to the 1032nd to 1029th data lines is used as the dummy pixel region, which is inappropriate since the center of the normal image and the center of the left-right inverted image are not matched for the panel (entire pixel region).

To overcome this problem, according to the present embodiment, in the R direction transmission, the pixel region of the 1029th to 1032nd data lines is used as the dummy pixel region, and in the L direction transmission, the pixel region of the 4th to 1st data lines is used as the dummy pixel region to obtain left and right symmetry of the image formed in the panel, in the L direction transmission.

Therefore, when left and right symmetry is not necessary, since it is not necessary to use the pixel region of the 1029th to 1032nd data lines as the dummy pixel region in the R direction transmission, the pixel region may be used as the effective pixel region. Similarly, in the L direction transmission, it is possible to use the pixel region of the 4th to 1st data lines as the effective pixel region to contribute to the display.

In addition, in the present embodiment, according to the XGA (eXtended Graphics Array) format, the number of effective pixels in the horizontal direction is '1024', the number of data lines 114 (the number of phase expansion) for simultaneously sampling the image signals by the same sampling signal is '4' which divides '1024'. Therefore, in this format, the number of phase expansion may be 8, 16, 32, and 48, in addition to 4. With more phase expansion, a reduction in the number of stages in the shift register 140 and frequency degradation of the clock signal CLX (CLXinv) may occur, and the dummy pixel region is gradually increased.

Figure 9:
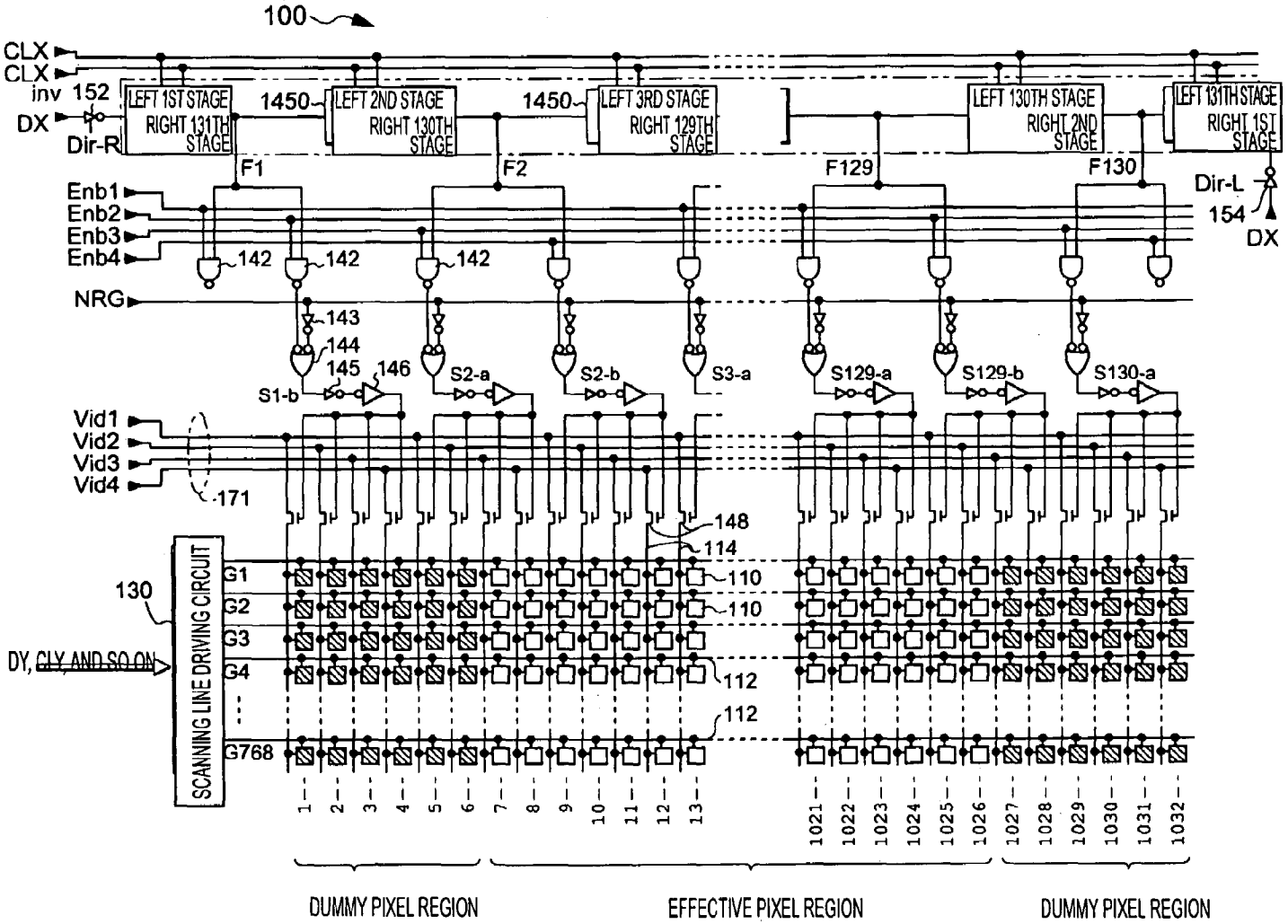
FIG. 9 is a block diagram showing an arrangement of an electro-optical panel for an electro-optical device according to another embodiment of the present invention.

In addition, as shown in FIG. 9, the 5th and 6th blocks, or the left end of the effective image region, and the 1027th and 1028th blocks, or the right end of the effective image region, may be used as the dummy pixel region.

This is because, in the pixel region corresponding to the 1st to 4th and 1029th to 1032nd data lines 114, difference in individual display quality may easily occur, but these data lines 114 and the 5th, 6th, 1027th and 1028th data lines 114 are spatially adjacent, as described above, and so these are easily affected by capacitive coupling. Here, the pixel region corresponding to the 5th and 6th data lines 114 is used as a buffer against the 1st to 4th data lines in which a difference in display quality with respect to the effective pixel region readily occurs, and the pixel region corresponding to the 1027th and 1028th data lines 114 is used as a buffer against the 1029th to 1032nd data lines in which a difference in display quality with respect to the effective pixel region readily occurs, so that the influence of the effective pixel region is reduced as much as possible.

Further, the number of effective pixels in the horizontal direction is '1022' in FIG. 9. Meanwhile, the number of effective pixels may be the number of pixels specified in a format, for example, '1024'. In that case, it is possible to divide the effective pixel region to '172' blocks by using '6' as the number of phase expansion. Further, it is possible to use the pixel regions corresponding to 4 data lines 114 at both ends of the left and right sides as a dummy pixel region.

With the dummy pixel region acting as the buffer described above, there is a lesser need to set the number of phase expansion to a number having a remainder of '0' when divided by the number of effective pixels in the horizontal direction.

Figure 10:
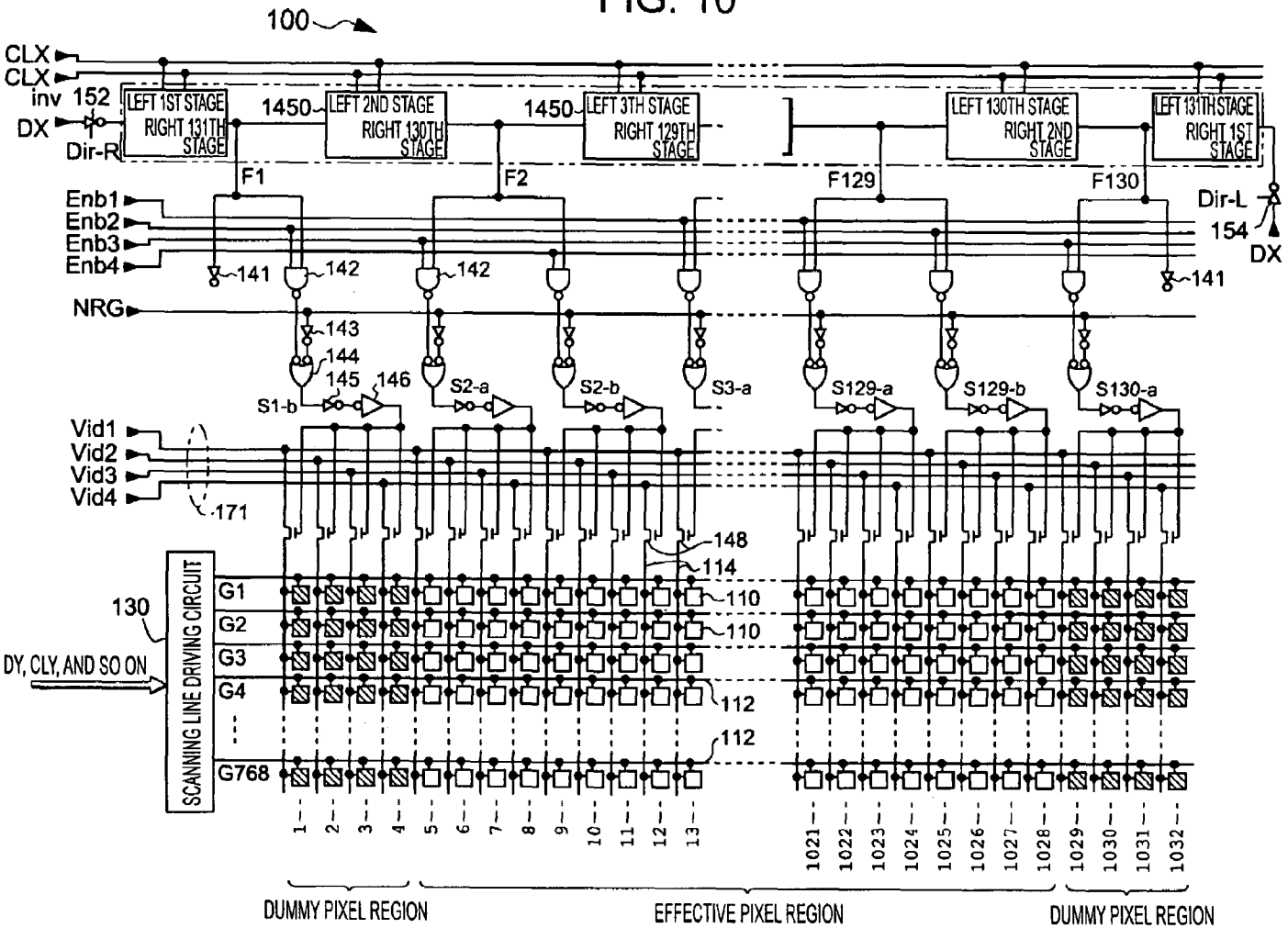
FIG. 10 is a block diagram showing an arrangement of an electro-optical panel for an electro-optical device according to another embodiment of the present invention.

Further, according to the present invention, while the path in which the output path of the signal F1 is branched to the left side and the path in which the output path of the signal F130 is branched to the right side, each have the NAND circuit 142, as in the other branched path, this output signal is not supplied anywhere, so that it may be replaced with the simple NOT circuit 141, as shown in FIG. 10.

Figure 11A:
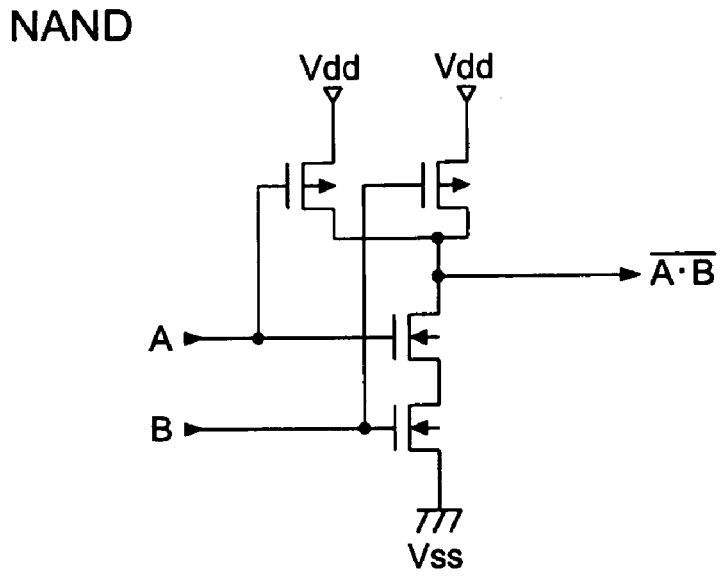
FIGS. 11A and 11B are diagrams showing an arrangement of a NAND circuit and a NOT circuit for the electro-optical panel according to an embodiment of the present invention.
Figure 11B:
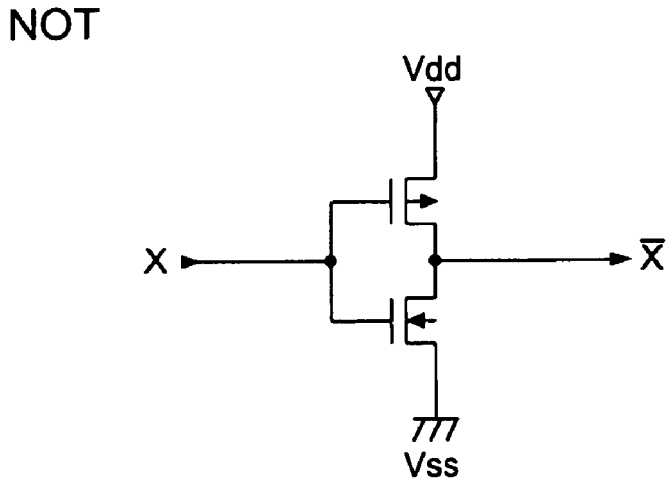

With the complementary NAND circuit 142, an arrangement shown in FIG. 11A is provided, and with the complementary NOT circuit 141, an arrangement shown in FIG. 11B is provided. Therefore, when seen from the branch path of the signals F1 and F130, a gate of the P-channel TFT and a gate of the N-channel TFT are commonly supplied in parallel, so that a parasitic capacitor in the output path of the signals F1 and F130 is substantially the same as the parasitic capacitor in the output path of other signals F2, F3, . . . , F129, and nonuniformity caused by a condition other than the latch condition is prevented.

In addition, while the present embodiment described above has described blackening the dummy pixel region that it does not contribute to display, examples of the non-display can be various types other than this.

For example, first, the pixel of the dummy pixel region need not be the minimum gray-scale level: it may be a color close to this, or it may be gray or black, or the maximum brightness.

Secondly, only the data line 114 is used as the dummy pixel region, and the pixel 110 may not be partially or fully formed. In addition, the data line 114 may be omitted. However, when a voltage variation of the counter electrode dominates over a difference between the signal output from the first stage for the shift register 140 and the signal output from the other stage, as a factor causing degradation of display quality, it is desirable that the pixel 110 in the dummy pixel region and the pixel 110 in the effective pixel region be the same since there is a need to prepare a certain amount of the capacitive coupling at the dummy pixel region and the effective pixel region.

Thirdly, whether or not the pixel 110 is formed, a light blocking layer (or liquid crystal) may be arranged corresponding to the portion of the dummy pixel region.

At any rate, preferably, pixels of the dummy pixel region may be discriminated from the pixels of the effective display region.

Further, while in the embodiments described above the processing circuit 300 processes digital image signals Vid, it may also process analog image signals. In addition, while the processing circuit 300 has an arrangement of S/P conversion followed by analog conversion, it may be an arrangement in which the S/P conversion expansion is followed by an analog conversion provided that the final result is the same analog signal.

Moreover, while the embodiments described above have been described in the context that low voltage effective values of the counter electrode 108 and the pixel electrode 18 have been described as a normally white mode for performing white display, it may be called as a normally black mode for performing black display.

While the embodiments described above use a TN-type liquid crystal, a bi-stable type liquid crystal having a memory characteristic, such as ferroelectric liquid crystal and a BTN (Bi-stable twisted nematic) liquid crystal, a polymer dispersion type liquid crystal, or a GH type (guest-host) type liquid crystal in which a dye (guest) having anisotropic due to absorption of visible light in a long axis direction and a short axis direction are resolved into a liquid crystal (host) of the constant molecular arrangement and the dye molecules are arranged in parallel with the liquid crystal molecules may be used.

In addition, vertical alignment (homeotropic alignment) may be provided such that the liquid crystal molecules are vertically arranged with respect to both substrates when the voltage is not applied, while the liquid crystal molecules are horizontally arranged with respect to both substrates when the voltage is applied. Parallel (horizontal) alignment (homogeneous alignment) may also be possible such that the liquid crystal molecules are vertically arranged with respect to both substrates when the voltage is applied, while the liquid crystal molecules are horizontally arranged with respect to both substrates when the voltage is not applied. In this way, in the present invention, since various types of liquid crystals can be used and liquid crystal molecules can be arranged by the alignment schemes, the liquid crystal device may be applicable to various electronic apparatuses.

While the liquid crystal device has been described, provided that the present invention has an arrangement such that the video data (video signal) is S/P expanded to be supply via the image signal lines, for example, it can be applied to a device such as an E1 (Electronic Luminescence) device, an electron emission device, an electrophoretic device, a digital mirror device, and a plasma display.

<Electronic Apparatus>

Next, as an example of an electronic apparatus using the electro-optical device according to an embodiment of the present invention, a projector using the electro-optical panel 100 as a light valve will be described.

Figure 12:
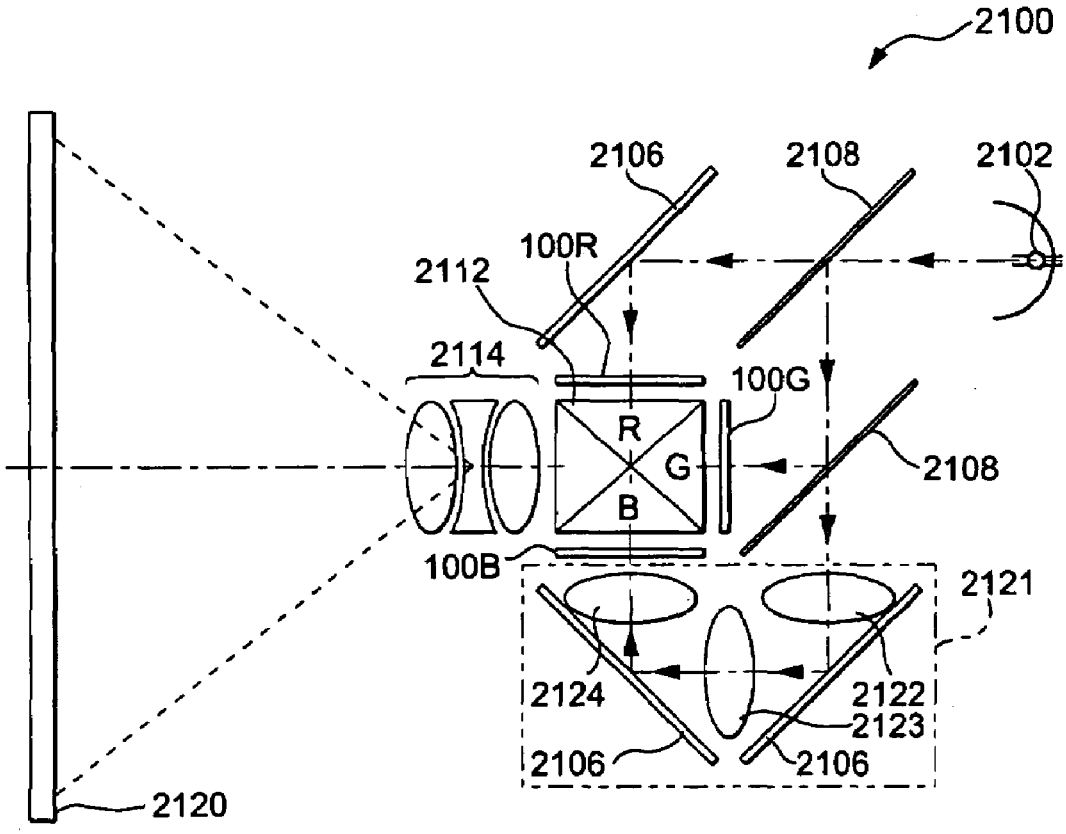
FIG. 12 is a diagram showing an arrangement of a projector adapted to the electro-optical device according to an embodiment of the present invention.

FIG. 12 is a plan view showing an arrangement of the projector. As shown FIG. 12, a lamp unit 2102 having a white light source, such as a halogen lamp, is arranged inside the projector 2100. Projection light emitted from the lamp unit 2102 is divided into the three primary colors R (red), G (green), and B (blue), by three mirrors 2106 and two dichroic mirrors 2108 arranged inside the projector 2100, and then is driven to light valves 100R, 100G, and 100B respectively corresponding to each primary color. In addition, since a B light component has a long optical length compared to R and G light components, a relay lens system comprising an incident lens 2122, a relay lens 2123, and an exit lens 2124 is used to prevent optical loss.

Here, the arrangements of the light valves 100R, 100G, and 100B have the same as that of the electro-optical panel 100 according to the embodiments described above, and they are respectively driven by image signals corresponding to each color, R, G, and B, supplied from a processing circuit (not shown in FIG. 12).

Light demodulated by the light valves 100R, 100G, and 100B, respectively, is incident on a dichroic prism from three directions. Further, in the dichroic prism 2112, the R light component and the B light component are refracted by 90 degrees, while the G light component propagates straight through. Therefore, after each color image is combined, a color image is projected to the screen 2120 through a projector lens 2114.

In addition, in the light valves 100R, 100G, and 100B, since light corresponding to each primary color R, G, and B is incident by the dichroic mirror 2108, a color filter is not required. In addition, transmission images of the light valves 100R and 100B are reflected and then transmitted by the dichroic prism 2112, and the transmission image of the light valve 100G is transmitted as is. Thus, the horizontal scanning directions of the light valves 100R and 100B are in the opposite direction to the horizontal scanning direction by the light valve 100G to display the left-right inverted image.

In addition, as an electronic apparatus, in addition to the example shown in FIG. 12, there can be employed a direct-vision type apparatus such as a mobile telephone, a personal computer, a television, a monitor of a video camera, a car navigation device, a pager, an electronic notebook, a calculator, a word processor, a workstation, a video call device, a POS terminal, a digital still camera, and an apparatus having a touch panel. In addition, it is needless to mention that the electro-optical device according to the present invention can be applied to these various electronic apparatuses.

What is claimed is:

1. An electro-optical device comprising:

scanning lines;

data lines intersecting the scanning lines, the data lines including blocks of plural data lines;

image signal lines that supply image signals;

pixels arranged correspondingly to intersections of the scanning lines and the data lines, for producing gray-scale levels in response to image signals from the image signal lines that are sampled on the data lines for horizontal scanning periods in which a plurality of scanning lines are selected;

a scanning line driving circuit for sequentially selecting the plurality of scanning lines for each horizontal scanning period;

a shift register including a plurality of stages that sequentially transmit transmission start pulse signals supplied at the beginning of each of the respective horizontal scanning periods according to a predetermined clock signal, the stages including a first/end stage which is the first stage or the last stage to receive the start pulse signal of a horizontal scanning period;

a first/end path for branching the pulse signal transmitted to the first/end stage to one branch and another branch;

an operation circuit for calculating logical operation signals of the branched pulse signal from the one branch and predetermined enable signals such that pulse widths do not overlap with each other; and a plurality of sampling switches, including a block of sampling switches that is electrically interposed between the image signal lines and one block of plural data lines, the one block of sampling switches being configured to turn on to sample the image signals supplied to the image signal lines onto the one block of plural data lines, wherein the signals are turned on and off substantially at the same time based on the same logic signals corresponding to the one block of plural data lines, wherein sampling switches and data lines corresponding to the another branch of the path are omitted.

2. An electro-optical device comprising:

scanning lines;

data lines intersecting the scanning lines, the data lines including blocks of plural data lines;

image signal lines that supply image signals;

pixels arranged correspondingly to intersections of the scanning lines and the data lines, for producing gray-scale levels in response to imaae signals from the image signal lines that are sampled on the data lines for horizontal scanning periods in which the scanning lines are selected;

a scanning line driving circuit for sequentially selecting the plurality of scanning lines for each horizontal scanning period;

a shift register including a plurality of stages that sequentially transmit a transmission start pulse signal supplied at the beginning of each horizontal scanning period according to a predetermined clock signal, the stages including a first end stage and a second end stage at opposite ends of the shift register;

a path for transmitting the pulse signal from one stage to a stage adjacent thereto being provided for each of the stages into a plurality of groups, each path being connected to two branches that branch the pulse signal in two;

an operation circuit for generating a plurality of sampling signals by performing logical operations on the branched pulse signals and predetermined enable signals such that pulses transmitted by the plurality of sampling signals do not overlap with each other; and a plurality of sampling switches controlled by said sampling signals, each sampling switch being electrically interposed between a corresponding one of said data lines and one of said image signal lines, for turning on and sampling the image signals supplied to the image signal lines onto the data lines, wherein sampling switches corresponding to data lines belonging to the same one of said blocks are turned on and off substantially at the same time by the same sampling signal, wherein sampling switches and data lines are provided in correspondence with one of the two branches corresponding to a path between the first end stage and a stage adjacent thereto and between the second end stage and a stage adjacent thereto, and no sampling switch or data line is provided for the other of the two branches corresponding to the path between the first end stage and the stage adjacent thereto and between the second end stage and the stage adjacent thereto.

3. The electro-optical device according to claim 2, wherein pixels corresponding to the sampling switches and data lines provided in correspondence with the one of the two branches corresponding to the path between the first end stage and the stage adjacent thereto and between the second end stage and the stage adjacent thereto are controlled to display as dummy pixel regions at opposite ends of the pixel matrix.

4. The electro-optical device according to claim 2, wherein the pixels in the dummy pixel regions are symmetrically located with respect to a center of an effective pixel region for performing display.

5. The electro-optical device according to claim 2, wherein the number of the data lines of an effective pixel region of the pixel matrix is a multiple of the number of the sampling switches turned on and off by the same logical operation signal.

6. The electro-optical device according to claim 2, wherein the operation circuit that corresponds to the other of the two branches corresponding to the path between the first end stage and the stage adjacent thereto comprises a NOT circuit that receives input of the pulse signal transmitted by the first end stage of the shift register, and that does not receive input of the corresponding enable signal.

7. The electro-optical device according to claim 6, wherein the operation circuit that corresponds to the other of the two branches corresponding to the path between the second end stage and the stage adjacent thereto each comprises a NOT circuit that receives input of the pulse signal transmitted by the second end stage of the shift register and that does not receive input of the corresponding enable signal.

* * * * *